United States Patent [19]

Benahim et al.

[11] Patent Number: 4,933,651

[45] Date of Patent: Jun. 12, 1990

[54] MULTICHANNEL COMBINER/DIVIDER

[75] Inventors: Guy Benahim, Champigny S/Marne; Jean-Michel Dutaut, Verrieres le Buisson; Jean-Claude Giraudon, Meudon la Foret, all of France

[73] Assignee: Thomson-CSF, Puteaux, France

[21] Appl. No.: 323,414

[22] Filed: Mar. 14, 1989

[30] Foreign Application Priority Data

Mar. 18, 1988 [FR] France ..... 88 03526

[51] Int. Cl.[5] ..... H01P 5/12

[52] U.S. Cl. ..... 333/125; 333/137; 333/248

[58] Field of Search ..... 333/125, 127, 128, 136, 333/137

[56] References Cited

U.S. PATENT DOCUMENTS

| | | | |
|---|---|---|---|
| 3,023,382 | 2/1962 | Borghetti . | |
| 4,673,899 | 6/1987 | Jespersen et al. | 333/137 |
| 4,700,145 | 10/1987 | Yelland et al. | 333/125 X |
| 4,812,782 | 3/1989 | Ajioka | 333/122 X |

FOREIGN PATENT DOCUMENTS 2045005 10/1980 United Kingdom .

OTHER PUBLICATIONS

RCA Review, vol. 47, No. 4, Dec. 1986, pp. 487–508; A. Fathy, et al.

The 14th European Microwave Conference Proceedings, Sep. 10–13, 1984, pp. 317–322.

*Primary Examiner*—Paul Gensler

*Attorney, Agent, or Firm*—Oblon, Spivak, McClelland, Maier & Neustadt

[57] ABSTRACT

Disclosed is a device to combine or divide the power values of electromagnetic signals and, more particularly, a device of the radial mode. In a combiner/divider which comprises two metallic disks defining an annular space of propagation, each channel is separated from the adjacent channel by a radial slot which is placed in the lower disk and extends from the central aperture to the peripheral ring. Furthermore, each channel thus defined has a radial ridge. The invention can be applied to transmitters, notably those used in radars.

12 Claims, 4 Drawing Sheets

MULTICHANNEL COMBINER/DIVIDER

BACKGROUND OF THE INVENTION

1. Field of the Invention

The invention concerns devices for the summation or combination of N equiphase and equiamplitude microwave signals coming from N power amplifiers or channels. It also concerns these same devices wherein a microwave signal is distributed or divided identically on N channels or paths.

The last power stages of microwave transmitters, notably those used in radars, are increasingly being made by means of semiconductor devices. Since the power given by the semiconductors has not yet attained that of the tubes, there is provision for combining the output signals from several identical channels to obtain the required power by addition. This combination or summation can be achieved in different ways.

2. Description of the Prior Art

One of these ways consists in the use of a structure of the cascade-connected couplers type as shown in FIG. 1. This structure has, for example, a number k of series-mounted couplers/dividers Dk to Dl which divide the input power Pe in the ratios of 1/k and k/k+1 so as to divert a signal with a power of Pe/k+1 to an amplifier Ak with a gain G and a signal with a power of kPe/k+1 to the input of the next coupler.

The amplified signals are recombined by means of k couplers/combiners or adders, Cl to Ck, which have the same ratio, as defined above, for the couplers/dividers Dl to Dk, so as to add up the signals which are applied to their two inputs.

A structure of this type enables the use of the same semiconductor-based power amplifiers A0 to Ak, the output signals of which are combined in the couplers, Ck to Cl, so that the power Pe of the signal at the input of the structure is multiplied by a gain G.

This structure has the major drawback of having high insertion losses, so that its efficiency falls rapidly with the number of amplification channels used. Furthermore, it is necessary to obtain very precise coupling values, which are all the more precise as the number of channels is great.

Another structure which is used is that of the chandelier type, such as the one shown schematically in FIG. 2. This figure shows only the part corresponding to the combination or addition of the output signals of N=8 ($N=2^n$) amplifiers A1 to AN, but it will be understood that the input signals of these amplifiers are obtained by a chandelier type divider system. The N output signals of the amplifiers A1 to AN are applied in twos to N/2=4 two-channel combiners, B1 to B4, which are known as "two-channel Wilkinson" type combiners. In turn, the N/2=4 signals resulting from the combination are applied to N/4=2 combiners, B5 and B6, and so on until there is only one output, that of the combiner B7 when N=8.

A structure of this type can be used to obtain efficient coupling among the different channels, but the insertion losses are proportionate to the number of series-connected elements.

A third structure used to make a combiner/divider is that of the radial type, implementing a so-called microstrip technology. As shown in FIG. 3, which gives a top view, it is formed by a circular substrate 1 made of a dielectric material which is metallized on the lower face. The upper face of the substrate 1 is divided into N=12 metallic sectors, each corresponding to a radial line, Sl to SN, which ends in a microstrip line Ll to LM, respectively connected to a terminal Dl to DN. The center of the radial sectors is coupled to a coaxial line (not shown). Resistors Rl to RN are connected among the different channels to absorb the difference in energies among the channels in the event of dissymmetry which might appear between the channels.

This structure has a high efficiency of about 95%, but it can be suitable only for relatively low power values of about 50 watts, in terms of mean value, and 1 to 2 kilowatts in terms of peak value at the center.

Finally, for greater peak power values, of the order of several kilowatts, a radial type of structure is used. However, this radial structure is one wherein the propagation of the waves takes place in a radial mode. As shown in FIGS. 4 and 5 which are, in the former case, a partially open top view and, in the latter case, a diametrical sectional view along the line V.V of FIG. 4, the structure has two parallel disks 10 and 11, which mutually define a circular space 12 that ends at the periphery of the disks by a wall 13. This wall 13 supports N =16 coaxial outputs 14, each connected to a coupler 15 placed on the internal periphery of the circular space 12. The top disk does not have any aperture, but the lower disk is open at its center to position a coupler 16, the central part 17 of which has a flared-out shape starting from a cylindrical bar 18, and a lateral part 19 of which has a cylindrical shape with a circular section, the rod/cylinder set forming a coaxial line.

In divider mode, the signals enter the center of the disk, and the flared part 17, called a "door knob", has the effect of gradually modifying the distribution of the electrical field so that it is propagated between the two disks 10 and 11. The density of the electrical field gets reduced with distance from the center, and the result thereof is a division by N when it is collected by N couplers 15.

Conversely, in combiner mode, wherein the signals are applied to the couplers 15, the electrical fields as well as the associated radial currents are increasingly intense towards the central part, and the result thereof is an addition of the signals applied, provided that these signals have the same phase and the same amplitude.

A device of this type is described, for example, in Bobby J. Sanders, "Radial Combiner runs Circles around Hybrids", *Microwaves,* Nov. 1980, pp. 55–58.

This type of structure is very efficient and enables the combination of many channels, N=110 in the above-mentioned article. It also enables peak power values of the order of several kilowatts to be obtained. However, the chief drawback is that the isolation between the channels is given by 10log 1/N, namely −13 db for N=20 so that, in combiner mode, the return wave received by a coupler 15, when several couplers are not powered, may be very high and may cause deterioration of the amplifiers in operation.

An aim of the present invention is to make a multichannel combiner/divider of the radial type, which has improved isolation so as to support an increased number of non-powered couplers, without any risk of deterioration in the amplifiers associated with the powered couplers.

SUMMARY OF THE INVENTION

The invention relates to a multichannel combiner/divider, of the radial type, for microwave signals of a wavelength b, comprising a set formed by:

a pair of circular or polygonal metallic disks, separated by a space with a thickness e, the lower disk acting as a support and having a central circular aperture in which there is placed a coupler between a coaxial line and the guide formed by the two disks;

a peripheral ring, which is fixed to the lower and upper disks and to which there are connected N external coaxial lines as well as N corresponding internal couplers, which are placed at regular intervals on said ring, the said set defining a closed cavity wherein at least one disk has N radial slots, which extend between the ring and the central aperture and are arranged on either side of each coupler so as to define N separate transmission channels.

The radial slots have a length which is a whole number multiple of b/4 and has an absorption resistor at each distance b/4.

Each transmission channel is provided with a radial ridge which extends from the center to the coupler and which may have a variable height.

The coupler is made by means of a blade which has the shape of a annular sector and is surmounted by a radial ridge, the height of which may be variable.

When the radial slots do not extend up to the center, the upper disk has radial slots which complete those of the lower disk.

Means are provided to absorb the microwave energy radiated by the radial slots. Of course, the roles of the lower and upper disks may be transposed. Furthermore, the radial ridges may be arranged on each disk provided that they are not in contact.

BRIEF DESCRIPTION OF THE DRAWINGS

Other features and advantages of the present invention will appear from the following description, made with reference to the appended drawings, of which.

DESCRIPTION OF A PREFERRED EMBODIMENT

Figure 1:
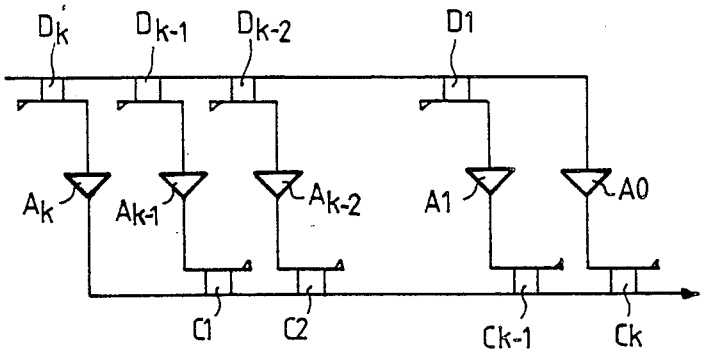
FIG. 1 shows a multichannel combiner/divider of the cascade-connected couplers type, according to the prior art.
Figure 2:
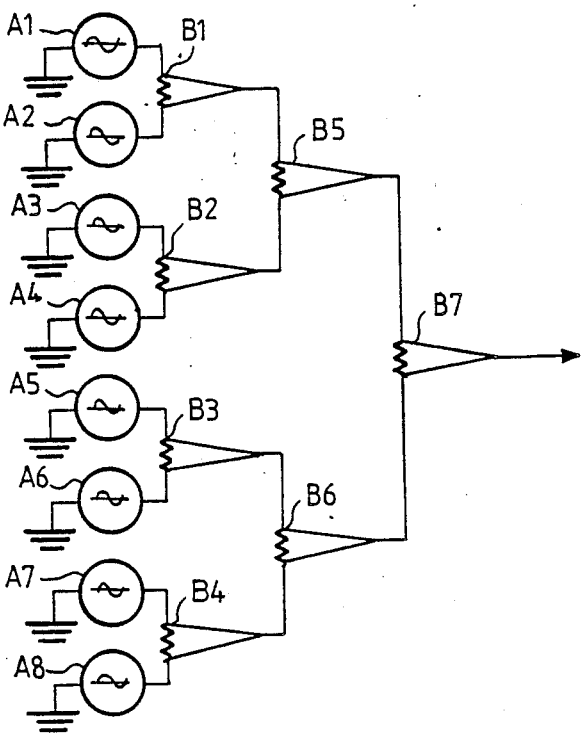
FIG. 2 shows a chandelier type multichannel combiner/divider according to the prior art.
Figure 3:
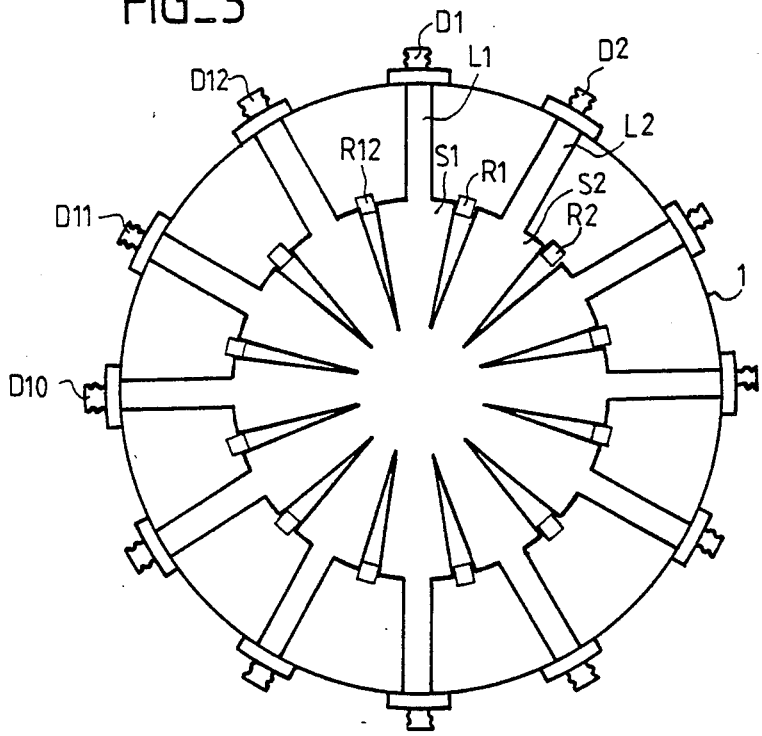
FIG. 3 shows a multichannel combiner/divider of the radial type, made with microstrip technology, according to the prior art.

FIGS. 1 to 5, which show prior art structures, have been described briefly in the introduction.

The multichannel combiner/divider according to the invention shall be described with reference to FIGS. 6 to 9. It comprises, as in the prior art structure of FIGS. 4 and 5, two circular metallic disks, a lower disk 20 and an upper disk 21, which are separated from each other by a distance e. This distance is imposed by the height of a peripheral wall or ring 22. This wall 22, which lies on the lower disk 20, is metallic and circular or polygonal. This wall acts as a support for the outer side. It has a number N=16 of coaxial connectors 41 which are uniformly distributed on the rim and into which are plugged coaxial cables not shown in the figure. On the inner side, namely in the annular space 23 between the two disks 20 and 21, each central conductor of the coaxial connectors 41 is fixed to each of the N=16 couplers 24, which shall be described in greater detail with reference to FIGS. 8 and 9. The wall 22 acts as a support and a fixing means for the two disks 20 and 21, by means of perforations, tapped holes and associated screws which have not been shown.

The upper disk 21 is solid. However, it may have radial apertures as shall be explained below. The lower disk 20 has a circular central aperture 25, in the middle of which there is a cylindrical rod 26 of a valve-shaped element 27, the head 30 of which comes into contact with the upper disk 21 and is fixed to it by any known means. On the edge 28 of the cylindrical aperture 25, there is fixed a cylindrical barrel or sleeve 29 which works together with the rod 26 to form a coaxial line. Furthermore, the head 30 of the element 27, and notably the flared-out part, works together with the annular space 23 to achieve an electromagnetic coupling between the coaxial line and said space 23. The coupling is obtained by gradually modifying the orientation of the electrical field as shown by the arrows 31 showing the direction of said field.

According to the invention, it is proposed to separate the couplers 24 from one another by radial slots 43 which not only stretch along the radial length of the couplers 24, but are extended towards the center up to a certain distance from the circular edge 28. The slots pass completely through the disk in the thickness direction. The length and width of the slots should be compatible with high mechanical strength, not only of the lower disk 20 but also of the entire set since it supports the rest of the structure.

Furthermore, from the electromagnetic point of view, the length of the radial slots is equal to 3b/4 if b is the wavelength of the electromagnetic waves. These N=16 slots mutually define N parallel channels which behave in a manner similar to microstrip lines. To absorb the dissymmetries between the channels, resistors 32 are placed at a distance b/4 from each end of the radial slots and are therefore mutually separated by b/4 in the case of a slot with a length 3b/4.

According to the invention, it is also proposed to place a radial metallic ridge 33 at the center of each channel, said ridge extending from the coupler 24 to the center. This ridge 33 tends to concentrate the electrical field at each channel.

Figure 8:
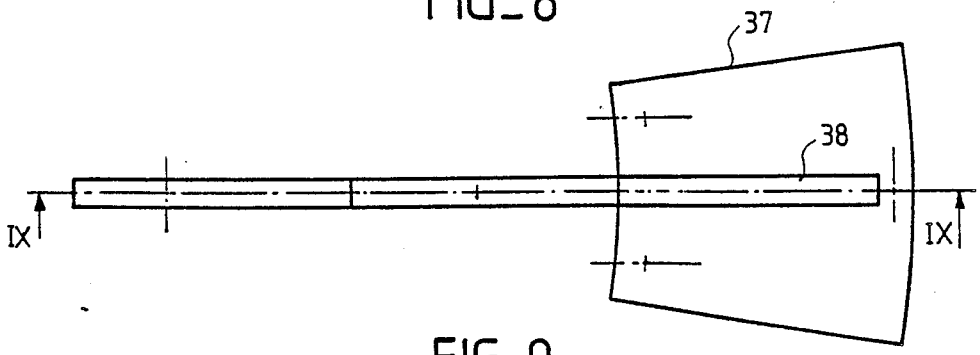
FIG. 8 shows a top view or a coupler and a ridge according to the invention, and, FIG. 9 shows a sectional view along the line IX—IX of FIG. 8.
Figure 9:
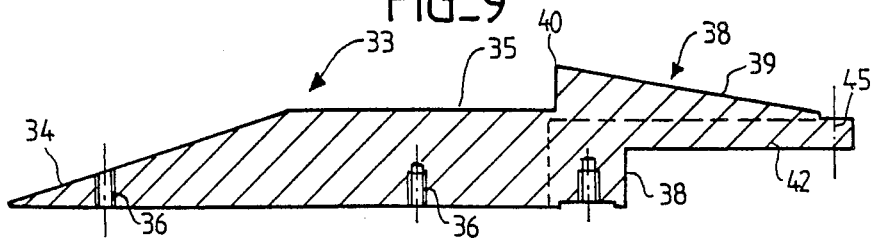
Figure 4:
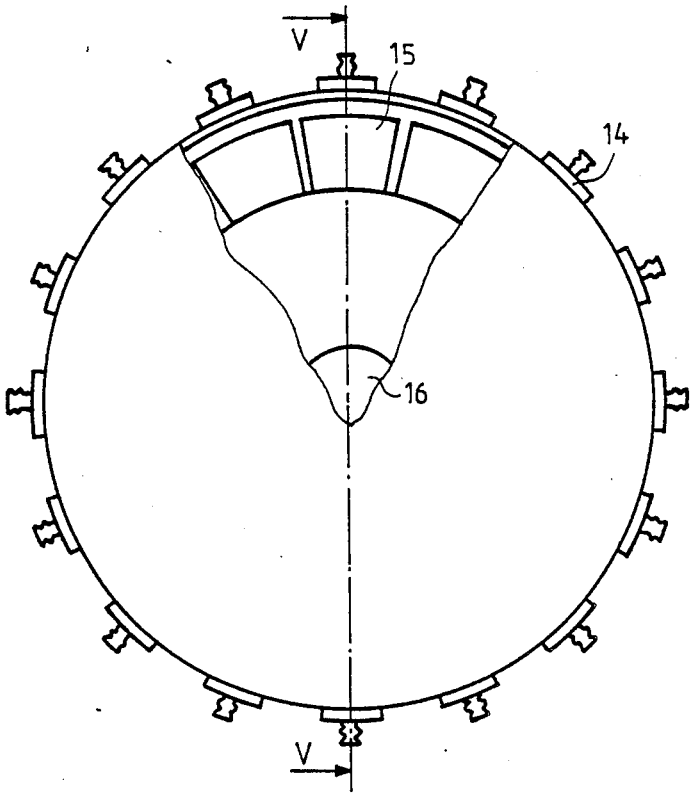
FIGS. 4 and 5 show top and sectional views of a multichannel combiner/divider, in radial mode, according to the prior art, FIGS. 6 and 7 respectively show top and sectional views of a multichannel combiner/divider according to the present invention.
Figure 5:
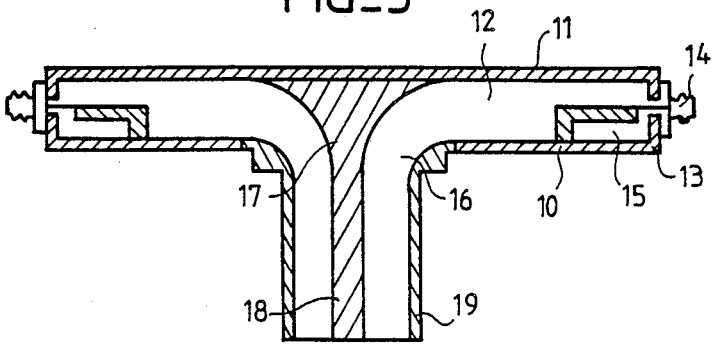
Figure 6:
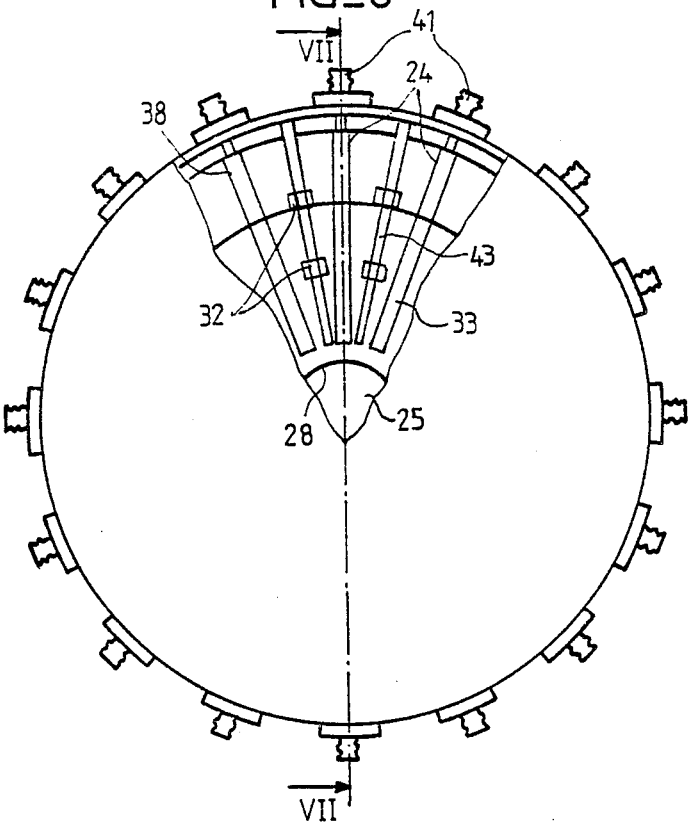
Figure 7:
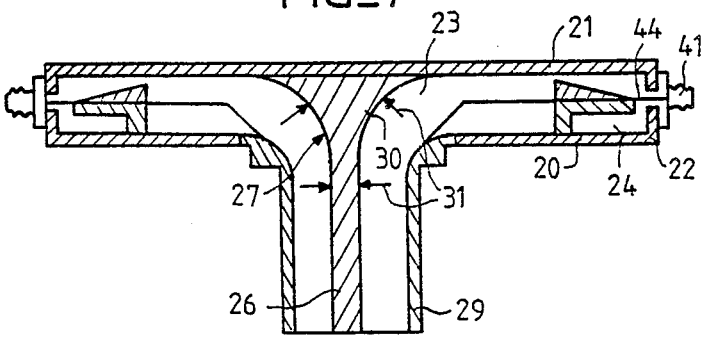

FIGS. 8 and 9 correspond to a particular, exemplary embodiment of a ridge 33 associated with a coupler 24. In vertical section (FIG. 9) the ridge 33 has, starting from the center, an inclined edge 34 which is continued towards the periphery by a horizontal edge 35, the height h of which is smaller than the distance e between the two disks 20 and 21. The ridges 33, which are a few millimeters thick, are fixed to the lower disk 20 by a system of tapped holes 36 working together with screws and holes of the lower disk 20 (not shown).

Each ridge 33 comes into mechanical and electrical contact with an associated coupler 24 formed by a metallic blade 37. In radial section, this blade 37 has the general shape of an L, one branch 38 of which rests on and is fixed to the lower disk 20 while the other branch 42 is electrically connected to the central conductor of the coaxial connector 41. The top of each blade 37 is surmounted by a ridge 46 arranged radially in the extension of the ridge 33. In vertical section, this ridge has an inclined edge 39, the peak 40 of each overhangs the ridge 33 and the height of which gradually decreases in the direction of the ring 22.

The electromagnetic coupling between each coaxial terminal 41 and the associated blade is achieved by any known means, notably by connecting the core 44 of the coaxial line 41 to the blade (place 45) so as to achieve a three-plate line short-circuited at b/4 (regular length of the blade).

The electromagnetic coupling between each blade 37 and the associated channel is achieved by a "Balun" type conversion between a coaxial symmetrical line and a dissymmetrical line in radial TEM mode.

Seen from the top (FIG. 8), the blade is shaped like a circular sector with a radial length of b/4 and an angular width which is slightly smaller than 360°/N=22.5° if N=16.

In the particular embodiment which has just been described in relation to FIGS. 6 to 9, the radial slots extend towards the ring and the central aperture of the lower disk 20. In certain applications, where the radius of the disks is greater than 3b/4, it may be preferable, notably for reasons of mechanical strength, not to increase the radial length of these slots, in leaving a zone without slots at the central aperture. In this case, it is proposed to make radial slots on the upper disk, in the vicinity of the head of the element 27. These new radial slots are located in vertical planes which also contain the radial slots of the lower disk so as to form the extension of these latter slots, with or without overlapping.

Owing to the presence of the radial slots, a part of the electromagnetic energy is radiated in the event of dissymmetry. Hence, it is proposed to absorb this radiation by placing absorbent materials in the vicinity of the slots outside the space 23.

The devices made according to the invention enable an isolation of −20 decibels to be obtained between channels for N=20. This value is to be compared with −13 decibels obtained in prior art devices for the same number of channels.

The invention has been decribed in relation to a particular embodiment, but it can also be implemented in a more general way. Thus, the roles of the lower and upper disks may be transposed while, at the same time, obtaining the results of the invention. Again, the radial lengths may have lengths other than 3b/4, for example lengths of b/4, b/2, or another whole number multiple of b/4. With these new lengths of slots, the resistors are placed at distances of b/4 from one another along each slot. Furthermore, the ridges may be placed on each disk provided that there is no electrical contact among them. Finally, in the above-described particular example, the slots may be made on the upper disk instead of being made on the lower disk.

What is claimed is:

1. A multichannel combiner/divider for microwave signals at a wavelength b, comprising:

a pair of substantially circular metallic disks, superimposed in space one over the other, so as to define a closed cavity having a central circular aperture receiving an input coaxial line and having a plurality of N radial channels each communicating at one end with said central aperture and having an opposite end;

a peripheral ring fixed to the upper and lower disks, said ring carrying a plurality of N couplers with each coupler having a corresponding coaxial line to which said opposite ends of said radial channels are in communication;

N corresponding internal couplers with one corresponding to each external coaxial line, said internal couplers being placed at regular intervals on said ring;

wherein each of said channels is provided with a radial radiation concentrating ridge essentially centered inside the channel and extending from about the central aperture towards the corresponding coupler and wherein each channel is provided with a pair of radial slots arranged on either side of the coupler of said channel, each of said pair of lateral slots being placed between adjacent channels.

2. A combiner/divider according to claim 1, wherein each radial slot has a length close to b/4 or to a whole number multiple of b/4,

3. A combiner/divider according to claim 2, wherein the slots have a length close to a whole number multiple of b/4, the edges of each radial slot being connected by resistors placed at distances of b/4 from one another.

4. A combiner/divider according to claim 1, wherein the radial ridge is fixed to at least one disk.

5. A combiner/divider according to claim 1, wherein the height of the radial ridge is smaller than the distance e between the circular disks.

6. A combiner/divider according to claim 1, wherein the height of the radial ridge is variable.

7. A combiner/divider according to claim 1, wherein the coupler is formed by an L-shaped blade, one branch of which is fixed to one of the two disks while the other branch is electrically connected to the central conductor of the coaxial line.

8. A combiner/divider according to claim 7, wherein the blade has a central ridge in the extension of the radial ridge of the transmission channel.

9. A combiner/divider according to claim 8, wherein the radial ridge of the blade of the coupler has an inclined edge, the height of which decreases towards the periphery.

10. A combiner/divider according to claim 1, wherein the radial slots on one of the two disks do not extend to the central aperture and wherein the other disk has radial slots placed in the vertical planes of the radial slots of the first disk.

11. A combiner/divider according to claim 10, wherein the radial slots of the other disk partly cover the radial slots of the first disk.

12. A combiner/divider according to claim 1, comprising means to absorb the microwave energy radiated by the radial slots.

* * * * *